US011953221B2

(12) United States Patent
Dushane et al.

(10) Patent No.: US 11,953,221 B2
(45) Date of Patent: Apr. 9, 2024

(54) EASY CONTROL TO SENSOR SELECT FOR HVAC SYSTEMS

(71) Applicant: Venstar, Inc., Chatsworth, CA (US)

(72) Inventors: Steven Dushane, Granada Hills, CA (US); Mustafa Oransel, Agoura Hills, CA (US)

(73) Assignee: Venstar, LLC, Chatsworth, CA (US)

( * ) Notice: Subject to any disclaimer, the term of this patent is extended or adjusted under 35 U.S.C. 154(b) by 376 days.

(21) Appl. No.: 17/166,292

(22) Filed: Feb. 3, 2021

(65) Prior Publication Data

US 2021/0247092 A1 Aug. 12, 2021

Related U.S. Application Data

(60) Provisional application No. 62/971,813, filed on Feb. 7, 2020.

(51) Int. Cl.

| | |
|---|---|
| ***F24F 11/63*** | (2018.01) |
| ***F24F 11/523*** | (2018.01) |
| ***F24F 11/58*** | (2018.01) |
| ***F24F 110/10*** | (2018.01) |

(52) U.S. Cl.

CPC ..... *F24F 11/63* (2018.01); *F24F 11/523* (2018.01); *F24F 11/58* (2018.01); *F24F 2110/10* (2018.01)

(58) Field of Classification Search

None

See application file for complete search history.

(56) References Cited

U.S. PATENT DOCUMENTS

| | | | | |
|---|---|---|---|---|
| 9,488,994 | B2 * | 11/2016 | Zywicki | G05B 19/048 |
| 2007/0045429 | A1 * | 3/2007 | Chapman | F24F 11/56 236/1 C |
| 2012/0067561 | A1 * | 3/2012 | Bergman | F24F 11/59 236/51 |
| 2014/0031990 | A1 * | 1/2014 | Filbeck | G05D 23/1904 700/276 |
| 2018/0320918 | A1 * | 11/2018 | Kojima | G05B 19/02 |
| 2019/0277528 | A1 * | 9/2019 | Malhotra | F24F 11/49 |
| 2021/0231335 | A1 * | 7/2021 | Ulrich | G01D 21/00 |
| 2022/0166529 | A1 * | 5/2022 | Wohlschlager | H04Q 9/00 |
| 2022/0221179 | A1 * | 7/2022 | Mundy | G06F 3/03547 |

* cited by examiner

*Primary Examiner* — Thomas C Lee
*Assistant Examiner* — Anzuman Sharmin
(74) *Attorney, Agent, or Firm* — Danner IP Law Firm; Allen D. Danner

(57) ABSTRACT

Systems and methods for controlling the ambient temperature within a region or zone of a building are disclosed. A system comprises a thermostat, one or more sensors placed throughout an environment, a computing cloud, and a remote mobile or desktop device running a software application ("app"). An end user may interact with an app running on the mobile device or desktop. The app may display the current conditions in a house and allow the user to select specific temperature sensors located throughout the house which the user wants to monitor and control. This selection of one or more temperature sensors is communicated to the computing cloud, and the computing cloud sends commands to the thermostat to monitor the user's selected temperature sensors for controlling the heating and cooling of the house.

19 Claims, 13 Drawing Sheets

EASY CONTROL TO SENSOR SELECT FOR HVAC SYSTEMS

RELATED APPLICATION INFORMATION

The present application claims priority under 35 U.S.C. Section 119(e) to U.S. Provisional Patent Application Ser. No. 62/971,813 filed Feb. 7, 2020 entitled "EASY CONTROL TO SENSOR SELECT FOR HVAC SYSTEMS" the disclosure of which is incorporated herein by reference in its entirety.

BACKGROUND OF THE INVENTION

1. Field of the Invention

The present invention relates in general to programmable thermostats for controlling air handling systems for heating, ventilation, and cooling. More particularly, the invention is directed to thermostats paired with remote sensors in which the thermostat is configured to maintain a local ambient temperature within a region based on a selection of the remote sensors.

2. Description of the Related Art

Many traditional homes and buildings may have one centrally located heating, ventilation, and air conditioning ("HVAC") system which is employed to regulate the indoor ambient temperature of buildings and are often controlled by a single thermostat. Often the ambient temperature may vary from room-to-room throughout the building as a result of unbalanced air flow, uninsulated air ducts, and activity and occupancy of the rooms. This variation in temperature throughout the building may make living conditions uncomfortable for the building occupants.

Accordingly, a need exists to provide a thermostat which can be programmed to regulate the ambient temperature in specific locations within a building.

SUMMARY OF THE INVENTION

In the first aspect, a system for controlling a local temperature of a zone within an environment is disclosed. The system comprises one or more temperature sensors placed within an environment, a thermostat controlling a Heating, Ventilation, and Air Conditioning ("HVAC") system, the thermostat paired with the one or more temperature sensors, and a computing cloud establishing a communication link with the thermostat, a communication link with the one or more temperature sensors, and a communication link with a computing device. The thermostat is configured to communicate a status of the thermostat to the computing cloud. The one or more temperature sensors is configured to communicate a status to the computing cloud. The computing cloud is configured to transmit the status of the thermostat and sensors to a computing device. The computing device is configured to communicate a selection of temperature sensors and temperature setpoints to the computing cloud. The computing cloud is configured to communicate the selection of temperature sensors and the temperature setpoints to the thermostat. The thermostat is configured to control the HVAC system by the thermostat based on the selection of temperature sensors and the temperature setpoints.

In a first preferred embodiment, the thermostat paired with the one or more temperature sensors comprises coupling the one or more temperature sensors to the thermostat via an access point. The thermostat paired with the one or more temperature sensors preferably comprises coupling the one or more temperature sensors to the computing cloud via an access point and coupling the computing cloud to the thermostat. The thermostat paired with the one or more temperature sensors preferably comprises coupling the one or more temperature sensors with a thermostat directly. The thermostat is preferably configured to control the HVAC system by the thermostat based on the selection of temperature sensors and the temperature setpoints comprises receiving the current measured temperatures of the selected temperature sensors, averaging the current measured temperatures to obtain an average measured temperature, and controlling the HVAC system based on the temperature setpoint and the average measured temperature. The selection of temperature sensors is preferably based on common characteristics of the selected temperature sensors.

The computing device is preferably further configured to communicate a schedule for selecting temperature sensors and temperature setpoints to the computing cloud, the computing cloud is preferably further configured to communicate the schedule for selecting temperature sensors and temperature setpoints to the thermostat, and the thermostat is further configured to control the HVAC system by the based on the schedule for selecting temperature sensors and temperature setpoints. The system preferably further comprises a software application executing on the computing device, wherein the computing device is further configured to display an indication status of the thermostat and sensors and receive commands from a user of the selection of temperature sensors and the temperature setpoints.

In a second aspect, a method for controlling a local temperature of a zone within an environment in a system comprising a thermostat controlling a Heating, Ventilation, and Air Conditioning ("HVAC") system, one or more sensors placed within an environment is disclosed. The method comprises pairing one or more temperature sensors with a thermostat, establishing a communication link between the temperature sensors and a computing cloud, the sensors communicating a status of the sensors, establishing a communication link between a thermostat and a computing cloud, the thermostat communicating a status of the thermostat, and transmitting the status of the thermostat and sensors from the computing cloud to a computing device. The method further comprises communicating the selection of temperature sensors and a temperature setpoint from the computing device to the computing cloud, communicating the selection of temperature sensors and the temperature setpoint from the computing cloud to the thermostat, and controlling a HVAC system by the thermostat based on the selection of temperature sensors and the temperature setpoint.

In a second preferred embodiment, the pairing the one or more temperature sensors with a thermostat comprises coupling the one or more temperature sensors to the thermostat via an access point. The pairing the one or more temperature sensors with a thermostat preferably comprises coupling the one or more temperature sensors to the computing cloud via an access point and coupling the computing cloud to the thermostat. The pairing the one or more temperature sensors with a thermostat preferably comprises coupling the one or more temperature sensors with a thermostat directly. Controlling a HVAC system by the thermostat based on the selection of temperature sensors and the temperature setpoint preferably comprises receiving the current measured temperatures of the selected temperature sensors, averaging the current measured temperatures to obtain an average measured temperature, and controlling the HVAC system based on the temperature setpoint and the average measured temperature. The selected temperature sensors preferably comprises a group of selected temperature sensors, wherein the group of selected temperature sensors is based on common characteristics of the selected temperature sensors.

The method preferably further comprises communicating a schedule for selecting temperature sensors and temperature setpoints from the computing device to the computing cloud, communicating the schedule for selecting temperature sensors and temperature setpoints from the computing cloud to the thermostat, and controlling a HVAC system by the thermostat based on the schedule for selecting temperature sensors and temperature setpoints. The method preferably further comprises executing a software application on the computing device, displaying an indication status of the thermostat and sensors, and receiving commands from a user of the selection of temperature sensors and the temperature setpoints.

In a third aspect, a system for controlling a local temperature of a zone within an environment is disclosed. The system comprises a thermostat controlling a Heating, Ventilation, and Air Conditioning ("HVAC") system, the thermostat paired with one or more temperature sensors, and a computing cloud establishing a communication link with the thermostat, a communication link with the one or more temperature sensors, and a communication link with a computing device. The thermostat is configured to communicate a status of the thermostat to the computing cloud. The one or more temperature sensors is configured to communicate a status to the computing cloud. The computing cloud is configured to transmit the status of the thermostat and sensors to a computing device. The computing device is configured to communicate a selection of temperature sensors and temperature setpoints to the computing cloud. The computing cloud is configured to communicate the selection of temperature sensors and the temperature setpoints to the thermostat. The thermostat is configured to control the HVAC system by the thermostat based on the selection of temperature sensors and the temperature setpoints.

In a third preferred embodiment, the thermostat paired with the one or more temperature sensors comprises coupling the one or more temperature sensors to the thermostat via an access point. The thermostat paired with the one or more temperature sensors preferably comprises coupling the one or more temperature sensors to the computing cloud via an access point, and coupling the computing cloud to the thermostat. The thermostat paired with the one or more temperature sensors preferably comprises coupling the one or more temperature sensors with a thermostat directly.

These and other features and advantages of the invention will become more apparent with a description of preferred embodiments in reference to the associated drawings.

BRIEF DESCRIPTION OF THE PREFERRED EMBODIMENTS

Many traditional homes and buildings rely on one, centrally-located heating, ventilation, and air conditioning ("HVAC") system to heat and cool the entire building. A conventional HVAC system typically relies on a single thermostat to control the HVAC system, where the thermostat has a built-in temperature sensor. When the measured temperature at the thermostat is no longer within user-specified temperature setpoints, the entire HVAC system may be activated to heat or cool the entire building.

While this may be adequate for smaller living or workspaces, this approach may result in non-uniform temperature variations for larger or multi-story environments. For example, a two-story house having a thermostat on the ground floor may exhibit higher temperatures on the second floor than that of the first floor which is monitored by the thermostat. The variations in temperature among floors or rooms may be a result of unbalanced air flow, improper thermal insulation, uninsulated air ducts, and activity and occupancy of the rooms.

Existing solutions to buildings having non-uniform ambient temperature may include the use of zone dampers to control flow of air in an HVAC system. These systems may have multiple motor driven dampers to control air flow from the HVAC system to individual zones within a building. However, the use of zone dampers may be problematic and expensive.

In one or more embodiments, systems and methods for controlling the ambient temperature within regions or zones of a building are disclosed. Embodiments disclosed herein do not require the use of zone dampers. In an embodiment, a system comprises a thermostat, one or more sensors placed throughout an environment such as a house or building, a computing cloud, and a remote mobile or desktop device running a software application ("app"). The computing cloud may communicate with the thermostat and the remote mobile or desktop device. An end user may interact with an app running on the mobile device or desktop, where the app may enable the end user to communicate preferences to the computing cloud. The app may display the current conditions in a house, for example, and allow the user to select specific temperature sensors located throughout the house. This selection of one or more temperature sensors is communicated to the computing cloud, and the computing cloud sends commands to the thermostat to monitor the user's selected temperature sensors for controlling the heating and cooling of the house.

Figure 1:
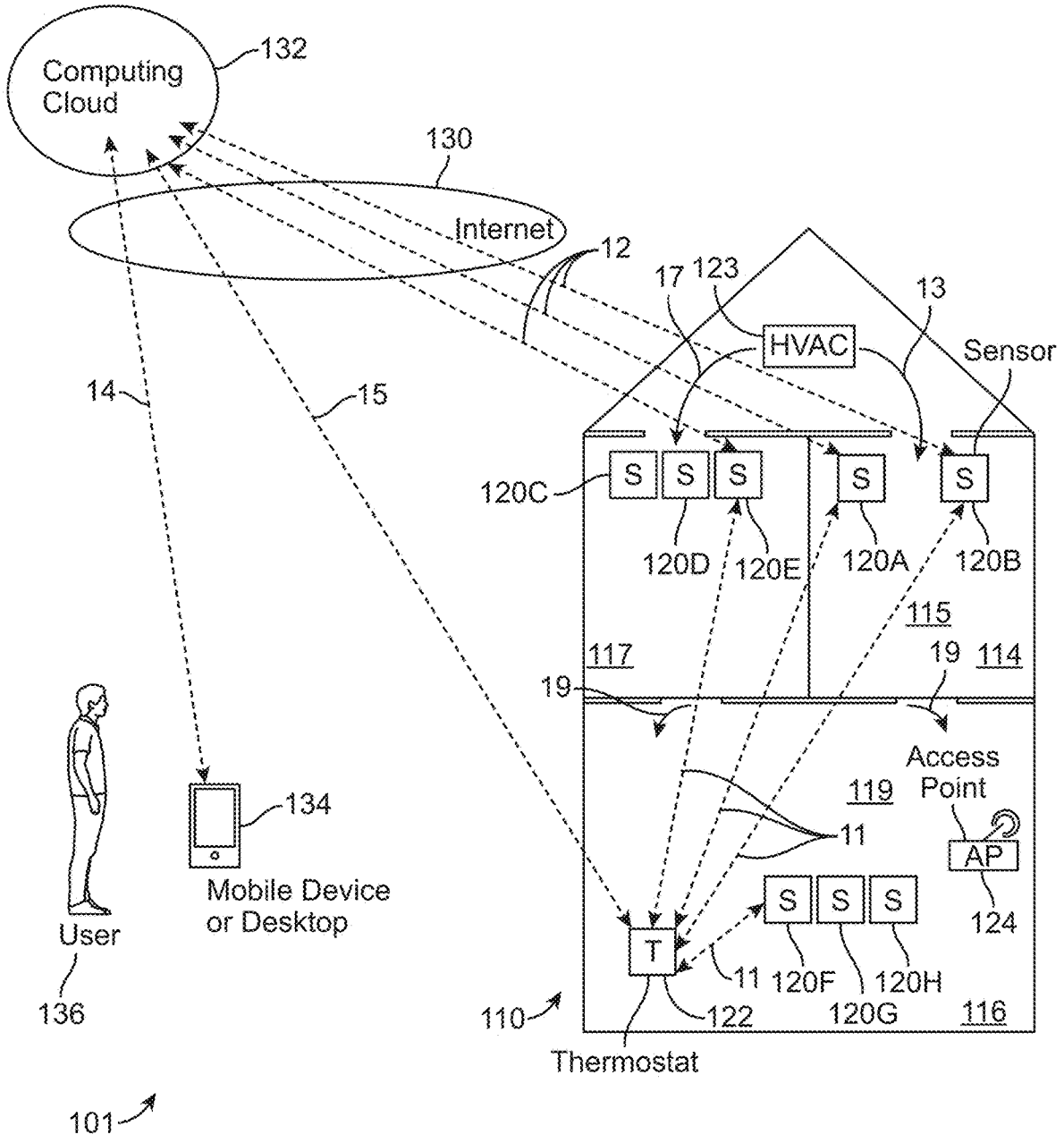
FIG. 1 is a schematic representation of a system for controlling a local temperature of a zone within an environment.

FIG. 1 is a schematic representation of a system 101 for controlling a local temperature of a zone within an environment 110. While embodiments herein illustrate the environment 110 as a two-story house, it shall be understood these embodiments are employed to illustrate operation within an environment, and that embodiments may be applied to other structures such as residential, commercial, and public buildings, as well as multiple story facilities.

The environment 110 comprises, for example, a two-story house having a first floor 116 and a second floor 114. The first floor 116 comprises a first zone 119, and the second floor 114 comprises a second zone 115 and a third zone 117. The system 101 for monitoring and controlling the temperature in the environment 110 comprises a HVAC 123 system, which is controlled by a thermostat 122. In an embodiment, the system 101 comprises a single thermostat 122 controlling a single HVAC system 123. The system 101 also comprises multiple remote sensors 120A-120H placed throughout the house 110. The remote sensors 120A-120H are paired and in communication with the thermostat 122. As shown schematically, the HVAC system 123 generates conditioned air through supply air 13 entering the second zone or room 115, supply air 17 entering the third zone or room 117, and supply air 19 entering the first zone 119.

The system 101 also comprises a computing cloud 132 which is accessible through the Internet 130. The computing cloud 132 is configured to communicate with a mobile device or desktop (i.e., computing device) 134 which is accessed and controlled by a user 136.

Figure 3:
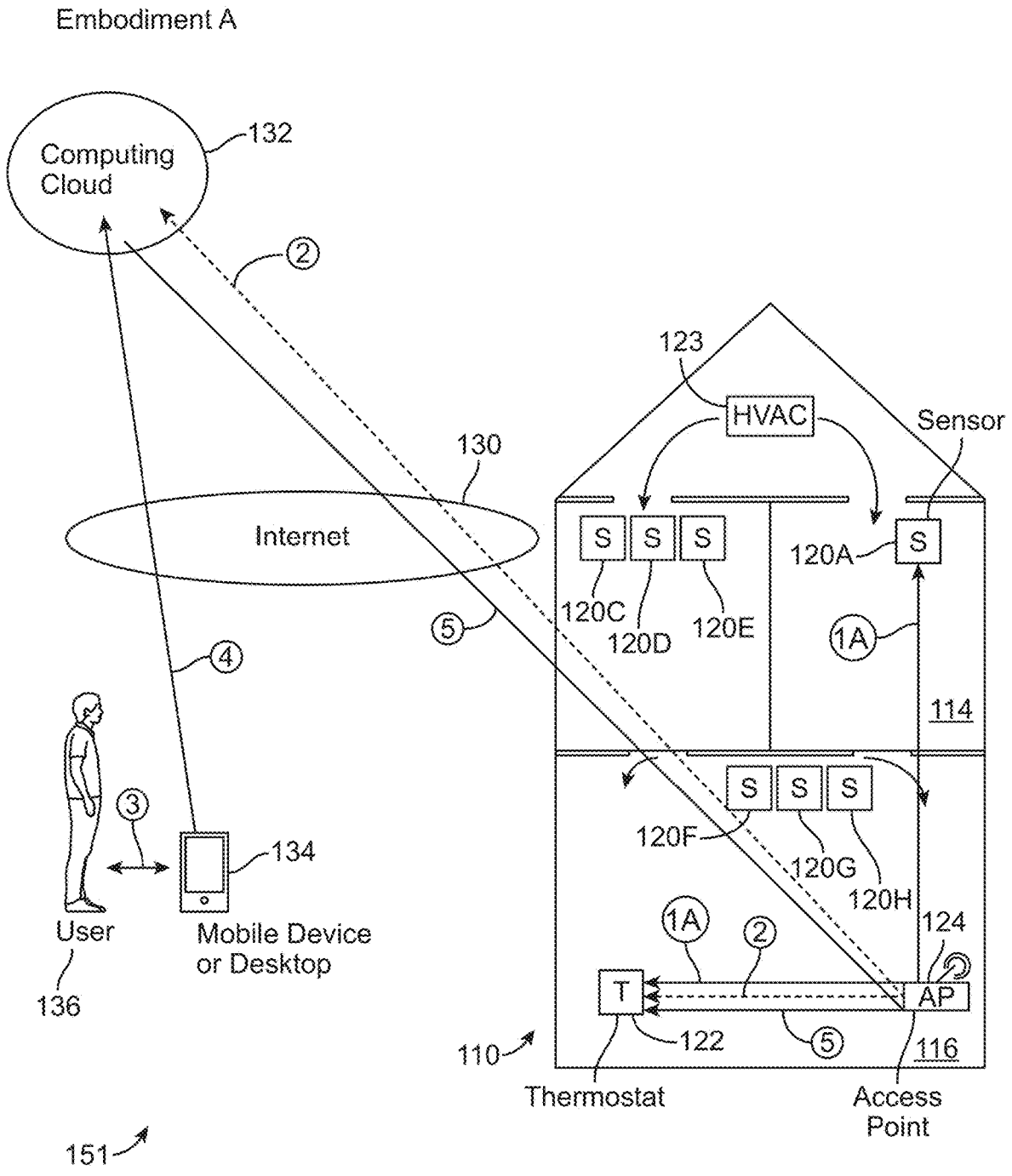
FIG. 3 is a schematic representation of a living environment and a system for selecting temperature sensors throughout the living environment, where the sensor is paired with the thermostat via an access point.

Multiple communication links 11, 12, 14, and 15 are formed by the system 101. The communication links 11, 12, 14, and 15 are depicted schematically as straight, dashed lines with arrows, and are used to represent the communication between the eventual components of the system 101. As will be discussed below, these communication links may not be direct connections between components and may rely on other intermediate devices to facilitate the communication links. For example, FIG. 3 presents an embodiment where the communication link 12 between the sensor 120 and the computing cloud 132 comprises (1) a communication link 1A where the sensor 120A communicates to the thermostat 122 via an access point 124 and (2) the communication link 5 from the thermostat 122 and the computing cloud 132.

As shown in FIG. 1, communication link 11 refers to the communication between the sensors 120A-120H and the thermostat 122, communication link 12 refers to the communication between the sensors 120A-120H and the computing cloud 132, communication link 14 refers to the communication between the computing cloud 132 and a mobile device or laptop 134, and communication link 15 refers to the communication between the computing cloud 132 and the thermostat 122.

In one or more embodiments, a system 101 for controlling a local temperature of a zone within an environment 110 comprises a thermostat 122 controlling a Heating, Ventilation, and Air Conditioning ("HVAC") system 123. In an embodiment, the system may further comprise one or more temperature sensors 120A-120H placed within an environment 110. The thermostat 122 is paired with one or more temperature sensors 120A-120H. The system 101 further comprises a computing cloud 132 establishing a communication link 15 with the thermostat, a communication link 12 with the one or more temperature sensors, and a communication link with a computing device 14. The thermostat 122 is configured to communicate a status of the thermostat 122 to the computing cloud 132 (via communication link 15). The status of the thermostat 122 may include a listing of sensors 120A-120H and the state of the sensors 120A-120H which are paired with the thermostat 122, the current measured temperature of the thermostat 122, weather conditions, as well as controls for operating the thermostat 122.

The one or more temperature sensors 120A-120H are configured to communicate a status to the computing cloud 132, such as current measured status and mode of operation of the sensors 120A-120H (via communication link 12). The computing cloud 132 is configured to transmit the status of the thermostat 122 and sensors 120A-120H to a computing device for user 136 (via communication link 14).

The computing device 134 is configured to communicate a selection of temperature sensors and temperature setpoints from the user 136 to the computing cloud 132 (via communication link 14). The computing cloud 132 is configured to communicate the selection of temperature sensors and the temperature setpoints to the thermostat 122 (via communication link 15). The thermostat 122 is configured to control the HVAC system 123 by the thermostat 122 based on the selection of temperature sensors and the temperature setpoint.

As an example to illustrate the operation of the system, consider a two-story house 110 having only one HVAC system 123, where the thermostat 122 is located downstairs (i.e., first floor 116) and the remote temperature sensor 120A is located upstairs in a bedroom (e.g., zone 115). The occupants are currently on the first floor 116 but wish to retire for the night to the bedroom (i.e., zone 115). When going to sleep upstairs to the bedroom, the occupants interface with the mobile device or desktop 134 (i.e., computing device) and select sensor 120A for monitoring (labeled BEDROOM SENSOR for example). Now the HVAC system 123 will control to the temperature in the bedroom while sleeping.

As another example, consider a dwelling with one HVAC unit 123 with the thermostat 111 located in a central hallway and a Home Office apart from the hallway. When the lone occupant of the house is working in the Home Office, the occupant will select the Home Office sensor for the HVAC system 123 to control to the sensor inside the Home Office.

Figure 2:
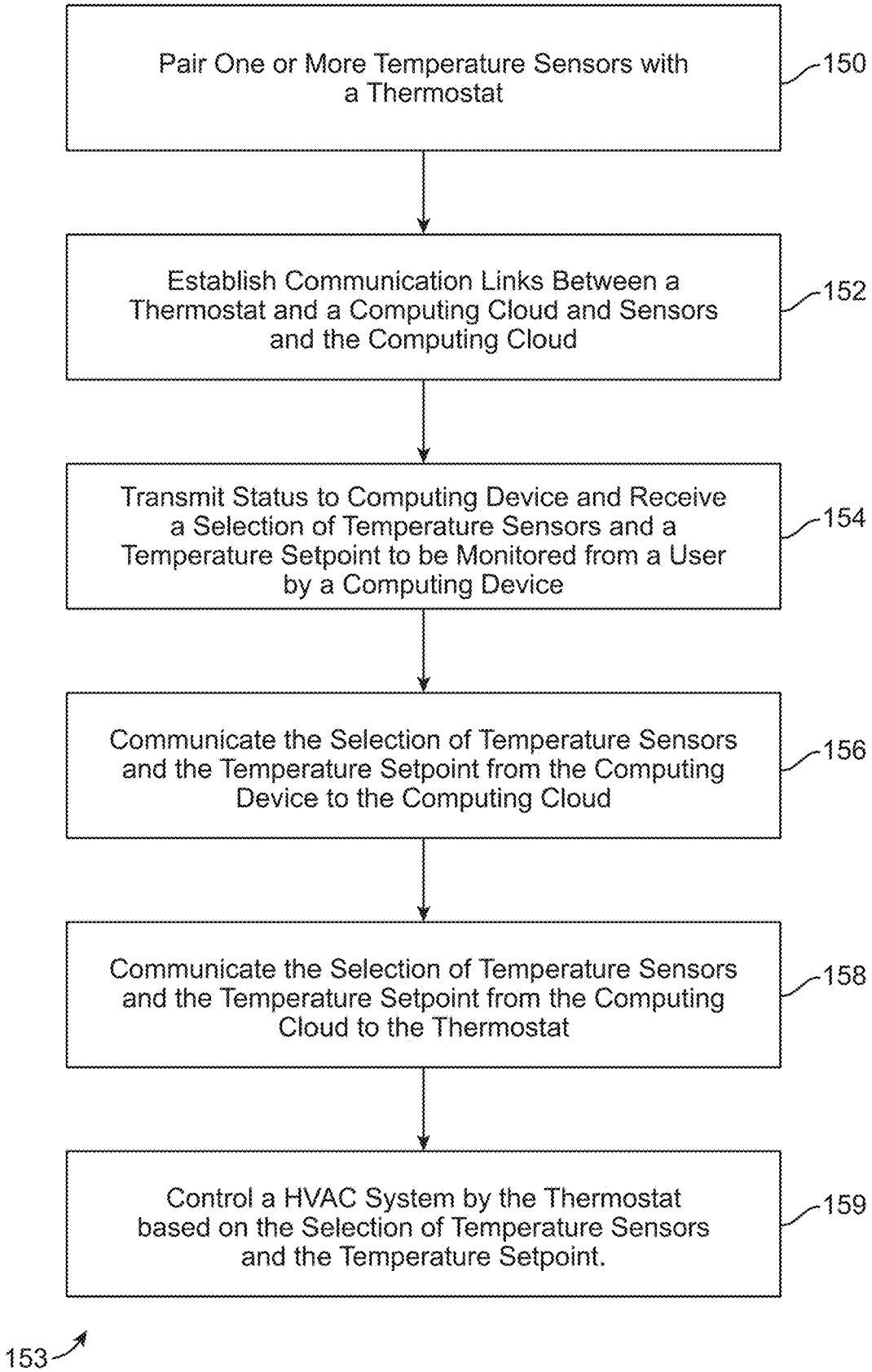
FIG. 2 is a flowchart showing an exemplary method for controlling the local temperature of the zone within the environment.

FIG. 2 is a flowchart showing an exemplary method 153 for controlling the local temperature of the zone within the environment 110. Pair one or more temperature sensors 120 with a thermostat 122 (step 150). Establish a communication link between a thermostat 122 and a computing cloud 132 and between the sensors 120 and the computing cloud 132 (step 152). Transmit the Status to computing device and receive a selection of temperature sensors and a temperature setpoint to be monitored from a user 136 by a computing device 134 (step 154). Communicate the selection of temperature sensors 120 and the temperature setpoint from the computing device 132 to the computing cloud 132 (step 156). Communicate the selection of temperature sensors 120 and the temperature setpoint from the computing cloud 132 to the thermostat 122 (step 158). Control a HVAC system 123 by the thermostat 122 based on the selection of temperature sensors and the temperature setpoint (step 159).

FIG. 3 is a schematic representation of a living environment 110 and a system 151 for selecting temperature sensors 120A-120H throughout the living environment 110, where the sensors 120A-120H are paired with the thermostat 122 via an access point 124. Comparing FIG. 3 to FIG. 1, FIG. 3 presents an embodiment where the communication link 12 between the sensor 120 and the computing cloud 132 comprises (1) a communication link 1A where the sensor 120A communicates to the thermostat 122 via an access point 124 and (2) the communication link 5 from the thermostat 122 and the computing cloud 132. In an embodiment, the thermostat 122 and the sensor 120 have a Wi-Fi device and transceiver 710 and 606 (See FIGS. 12 and 13).

Figure 4:
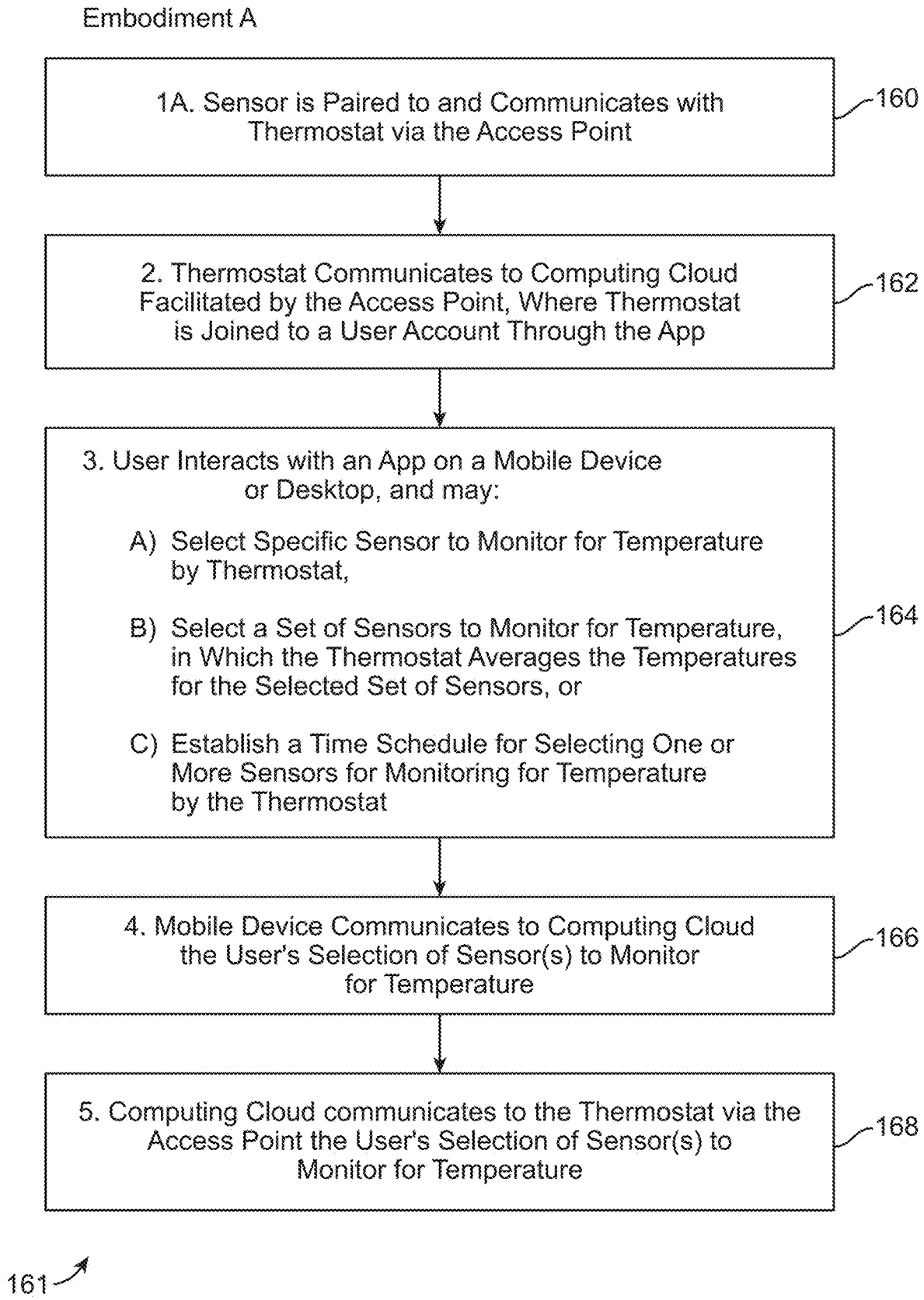
FIG. 4 is a flow chart illustrating an exemplary method for selecting temperature sensors via an app running on a mobile device or desktop, where the sensor is paired with the thermostat via an access point.

FIG. 4 is a flow chart illustrating an exemplary method 161 for selecting temperature sensors 120 via an app running on a mobile device or desktop 134. The individual steps listed in the flow chart are depicted schematically in FIG. 3. First, one or more sensors 120 are paired and communicates with the thermostat 122 via the Access Point 124 (step 160, depicted as "1A" on FIG. 1). The thermostat communicates to computing cloud 132 facilitated by the Access Point 124, where the thermostat 122 is joined to a computing cloud account through the app (Step 162, depicted as "2" on FIG. 1).

The user 136 interacts with an app on a mobile device or desktop 134, and may: (1) select a specific sensor 120 to monitor for temperature by the thermostat 122, (2) select a set of sensors 120 to monitor for temperature, in which the thermostat 122 averages the temperatures for the selected set of sensors 120, or (3) establish a time schedule for selecting one or more sensors 120 for monitoring for temperature by the 122 thermostat (step 164, depicted as "3" in FIG. 1). The mobile device or desktop 134 communicates to computing cloud 132 the user's selection of sensor(s) 120 to monitor for temperature (Step 166, depicted as "4" in FIG. 1). Computing cloud 132 communicates to the thermostat 122 via the access point 124 the user's selection of sensor(s) to monitor for temperature (step 168, depicted as "5" in FIG. 1).

Figure 5:
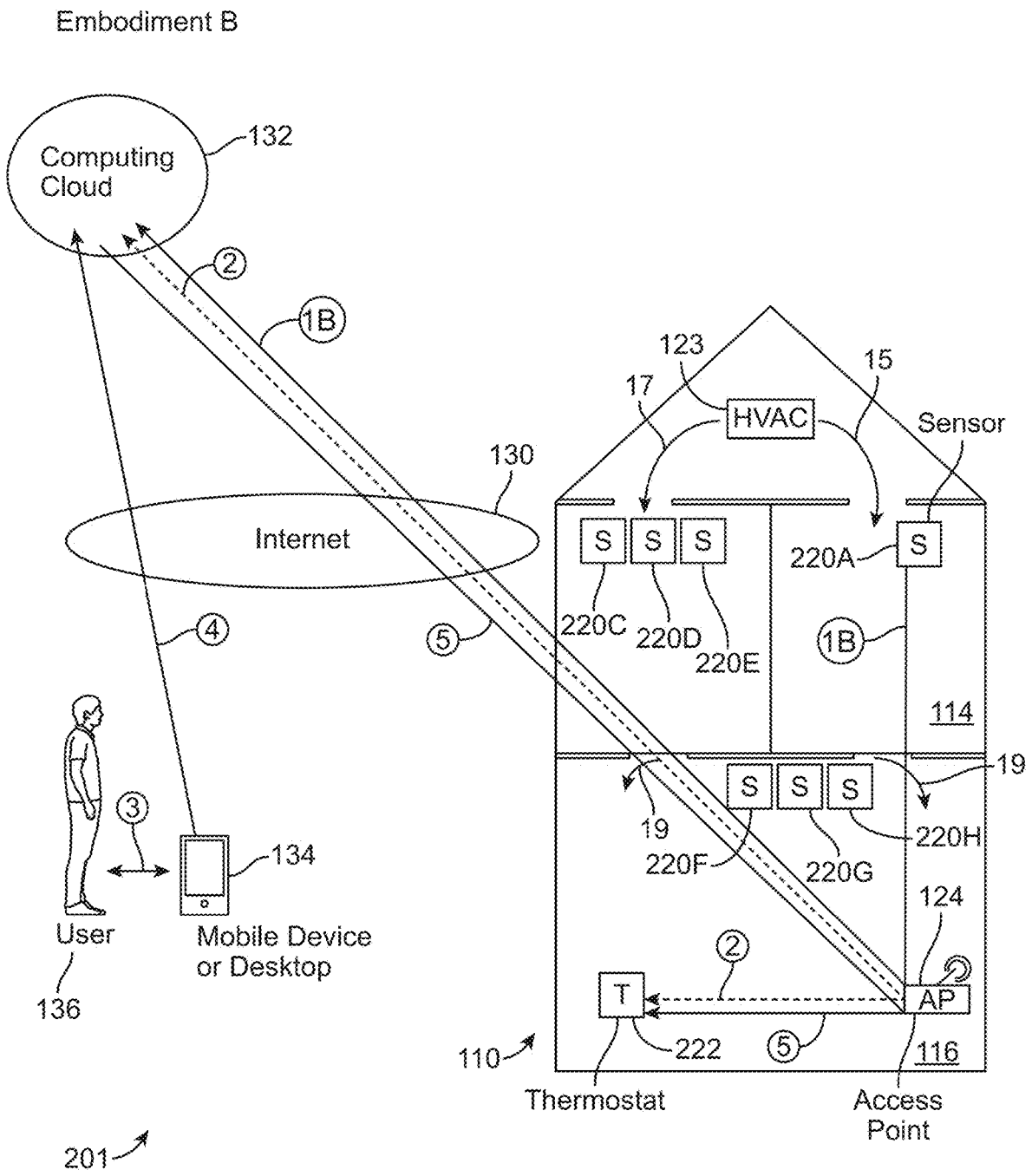
FIG. 5 is a schematic representation of a living environment and a system for selecting temperature sensors throughout the living environment, where the sensor communicates directly to a computing cloud via an access point.

FIG. 5 is a schematic representation of a living environment 110 and a system 201 for selecting temperature sensors throughout the living environment 110, where the sensors 120A—120H communicate directly to a computing cloud 132 via an access point 124. In an embodiment, a system 201 for selecting temperature sensors comprises one or more temperature sensors 220A-220H located throughout the house 110, a thermostat 222 for controlling the HVAC system 123, and access point 124, a computing cloud 132, and a mobile device or desktop 134 running an app. In one or more embodiments, the sensors 220 may include hardwired devices. In an embodiment, the thermostat 122 and the sensor 120 have a Wi-Fi device and transceiver 710 and 606 (See FIGS. 12 and 13).

Figure 6:
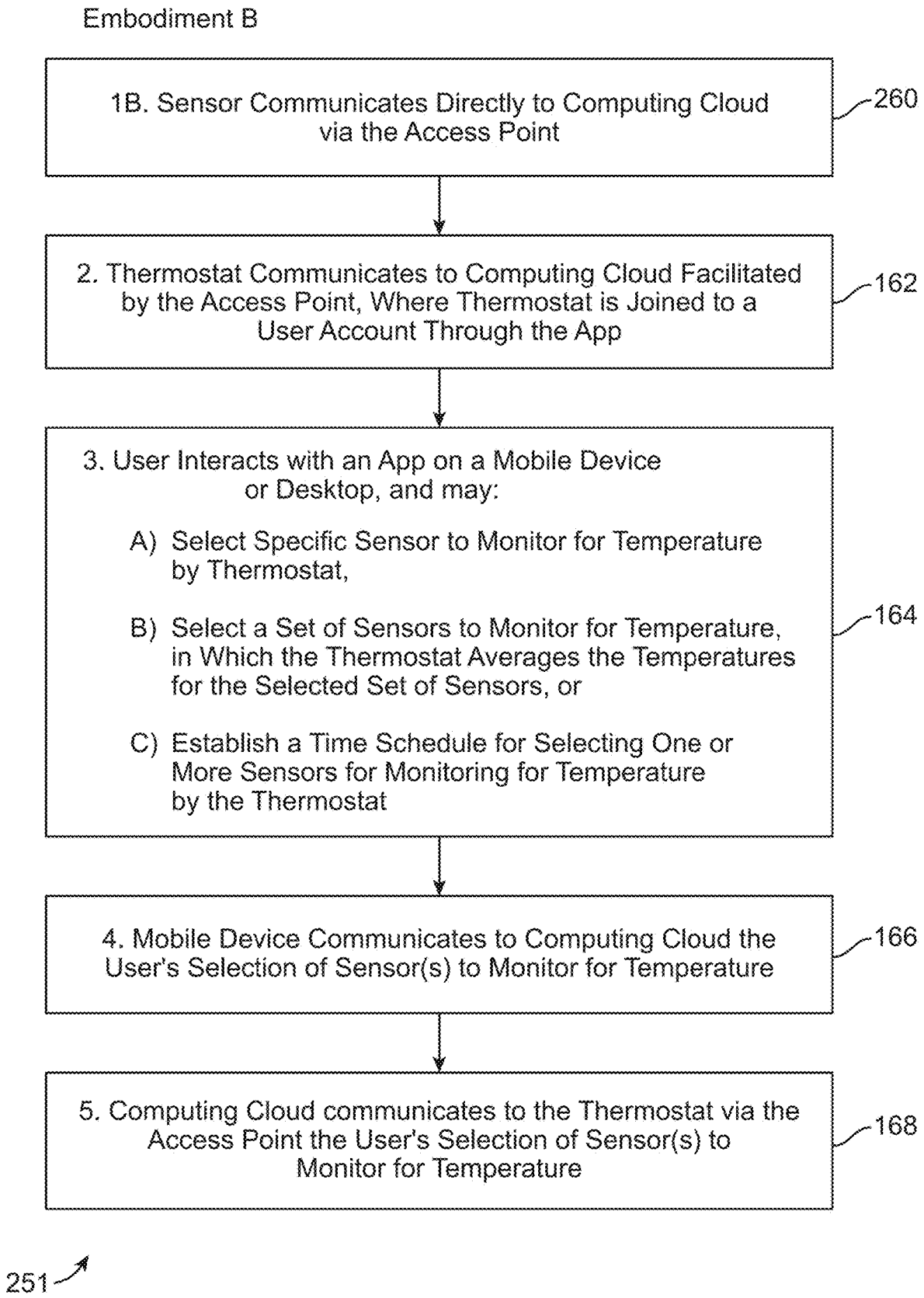
FIG. 6 is a flow chart illustrating an exemplary method for selecting temperature sensors via an app running on a mobile device or desktop, where the sensor communicates directly to a computing cloud via an access point.

FIG. 6 is a flow chart illustrating an exemplary method 251 for selecting temperature sensors 220 via an app running on a mobile device or desktop 134. The individual steps listed in the flow chart or depicted schematically in FIG. 5. In an embodiment, sensor 220 communicates directly to computing cloud 132 through the access point 124 (step 260, depicted as "1B" in FIG. 3). Steps 162 through 168 are described above with respect to FIG. 2.

Figure 7:
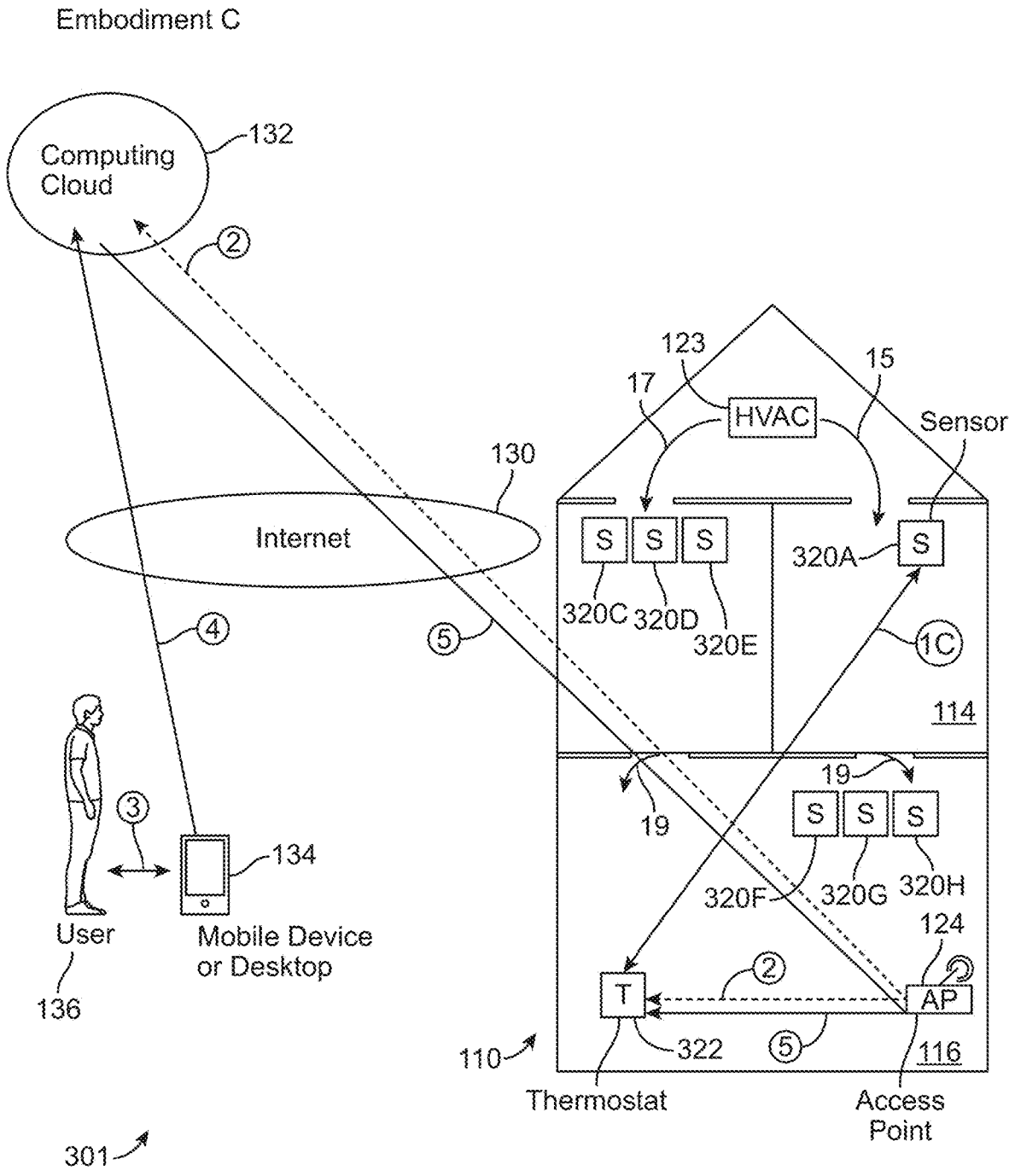
FIG. 7 is a schematic representation of a living environment and a system for selecting temperature sensors throughout the living environment, where the sensor communicates directly to the thermostat.

FIG. 7 is a schematic representation of a living environment 110 and a system 301 for selecting temperature sensors 320 throughout the living environment 110, where the sensors 320A-320H communicate directly to the thermostat 322. In an embodiment, the sensors 320A-320H and the thermostat 322 communicate via a sub-GHz transceiver 608, 714 (See FIGS. 12 and 13). In embodiment, a system 301 for selecting temperature sensors comprises one or more temperature sensors 320 located throughout the house 110, a thermostat 322 for controlling the HVAC system 123, and access point 124, a computing cloud 132, and a mobile device or desktop 134 running an app. In one or more embodiments, the sensors 320 may include hardwired devices.

Figure 8:
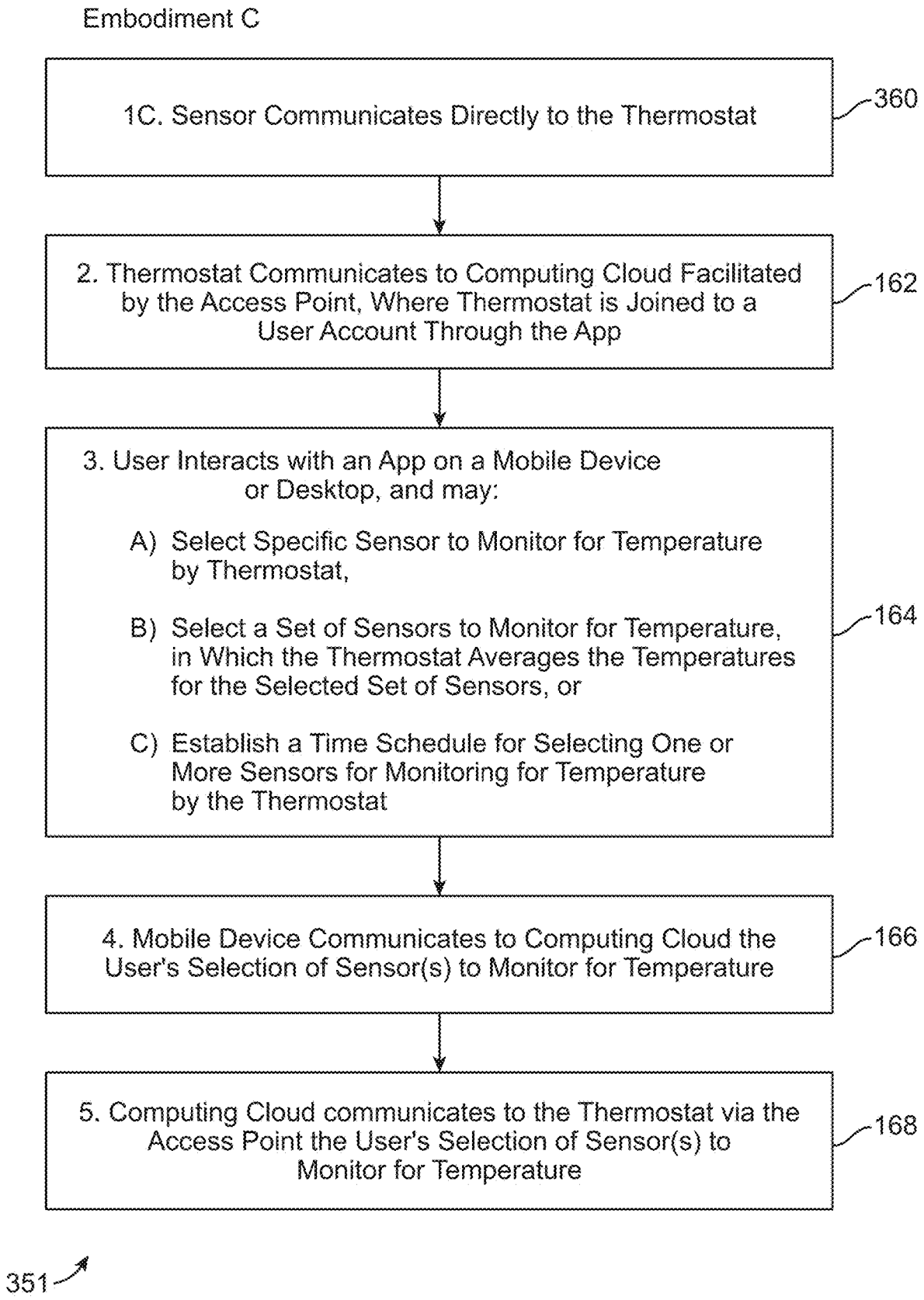
FIG. 8 is a flow chart illustrating an exemplary method for selecting temperature sensors via an app running on a mobile device or desktop, where the sensor communicates directly to the thermostat.

FIG. 8 is a flow chart illustrating an exemplary method 351 for selecting temperature sensors 320 via an app running on a mobile device or desktop 134. The individual steps listed in the flow chart or depicted schematically in FIG. 7. In an embodiment, sensor 320 communicates directly to the thermostat 322 (step 360, depicted as "1C" in FIG. 5). In an embodiment, sensor 320 communicates with thermostat 322 wirelessly. Steps 162 through 168 are described above with respect to FIG. 2.

Figure 9:
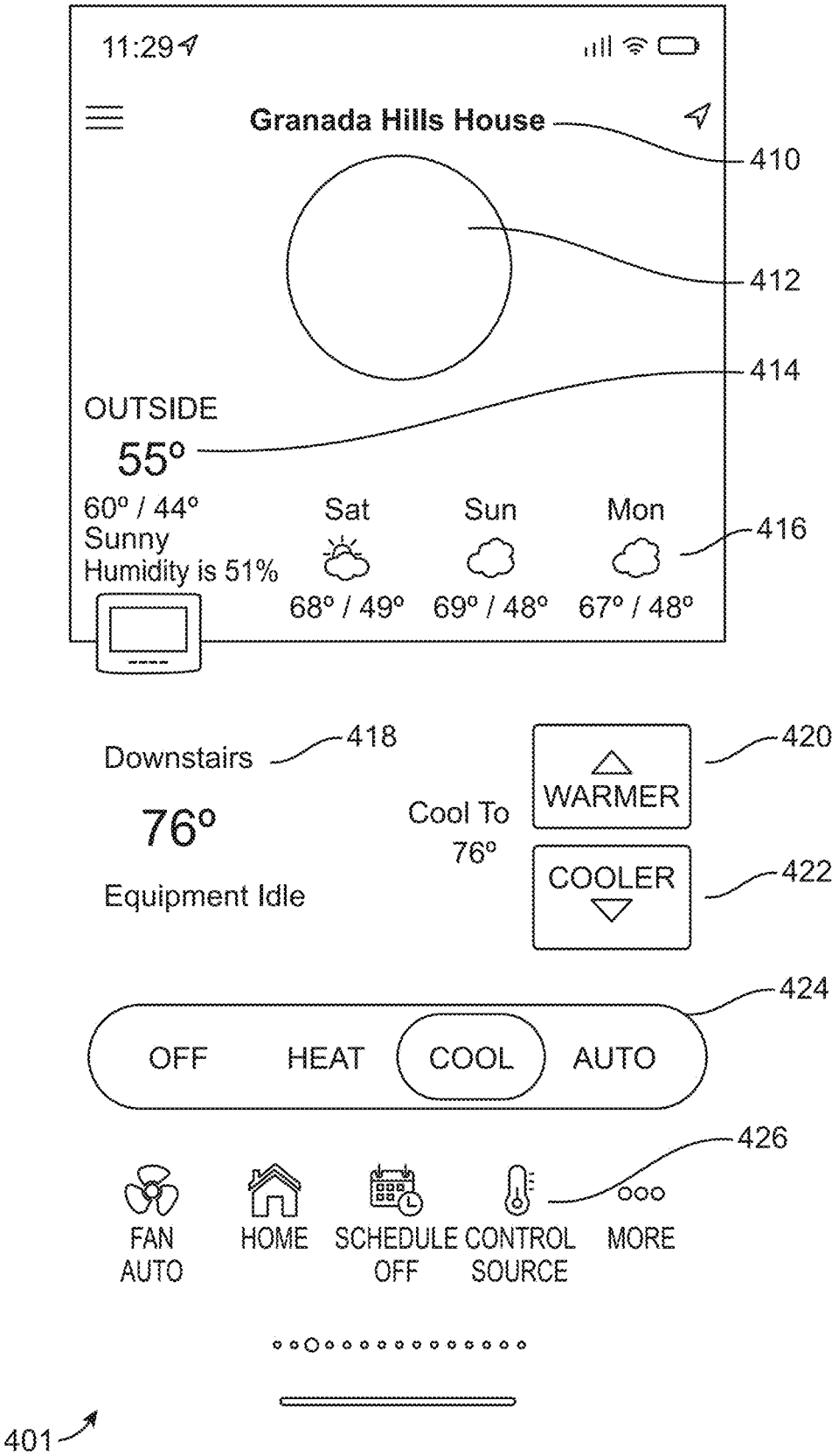
FIG. 9 is an exemplary screenshot of a display of a mobile device, through which an end user may interact to select the sensor to be monitored by the thermostat.

FIG. 9 is an exemplary screenshot 401 of a display of a mobile device 134 running a software app, through which an end user 136 may interact to select the sensor 120/220/320 to monitor by the thermostat 122/222/322. The display may show the location of the home or environment 410, indicia of the local weather 412 such as by a representation of the Sun to indicate sunny weather, current outside temperature of the environment 414, indicia of a weather forecast 416, the current inside temperature 418, virtual control buttons 420 and 422 for raising or lowering the temperature set point, the status of the thermostat 424, and a "CONTROL SOURCE button" 426 for selecting the Control Source.

As a brief review, in one or more embodiments, the thermostat 122 may be configured to control the HVAC system 123 by receiving the current measured temperatures of the selected temperature sensors, averaging the current measured temperatures to obtain an average measured temperature, and controlling the HVAC system based on the temperature setpoint and the average measured temperature. In an embodiment, the selection of temperature sensors may be based on common characteristics of the selected temperature sensors. Common characteristic refers to ways of grouping temperature sensors such as by grouping all wireless sensors (FIG. 10, 514), grouping wired sensors (FIG. 10, 516), grouping remote sensors and temperature sensor within the thermostat (FIG. 10, 518), and grouping all available sensors (FIG. 10, 520).

Figure 10:
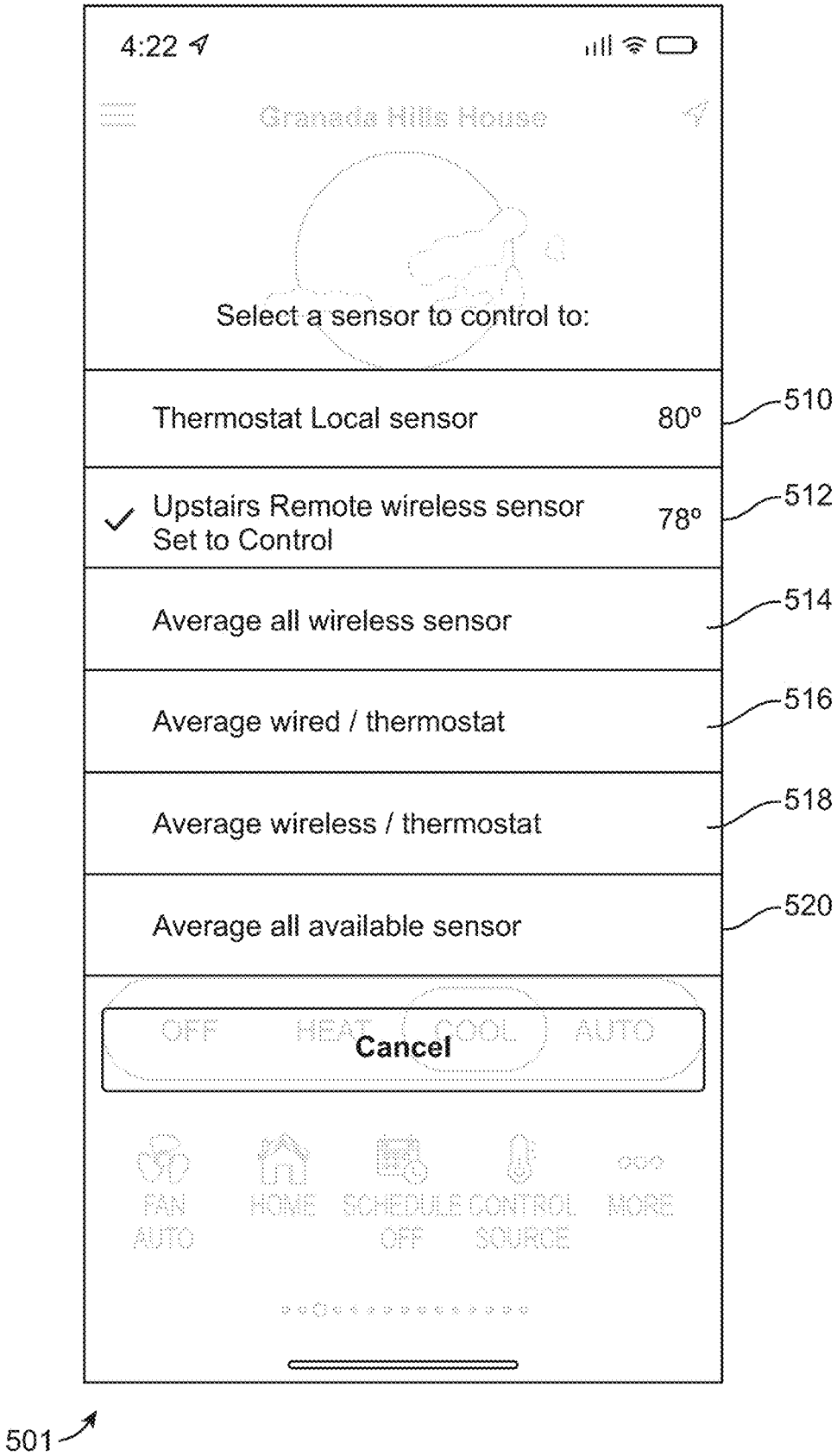
FIG. 10 is an exemplary screenshot of a display of a mobile device that appears after the end user selects "Control Source."

FIG. 10 is an exemplary screenshot 501 of a display of a mobile device 134 that appears after the end user 136 selects "Control Source" 426. The display may enable the user to select the temperature sensor in the thermostat 510, a specific temperature sensor 120/220/320 such as the "Upstairs Remote wireless sensor" 512, the average of all wireless sensors 514, the averages of wired/thermostat 516, average wireless/thermostat 518, or average all available sensors 520.

Figure 11:
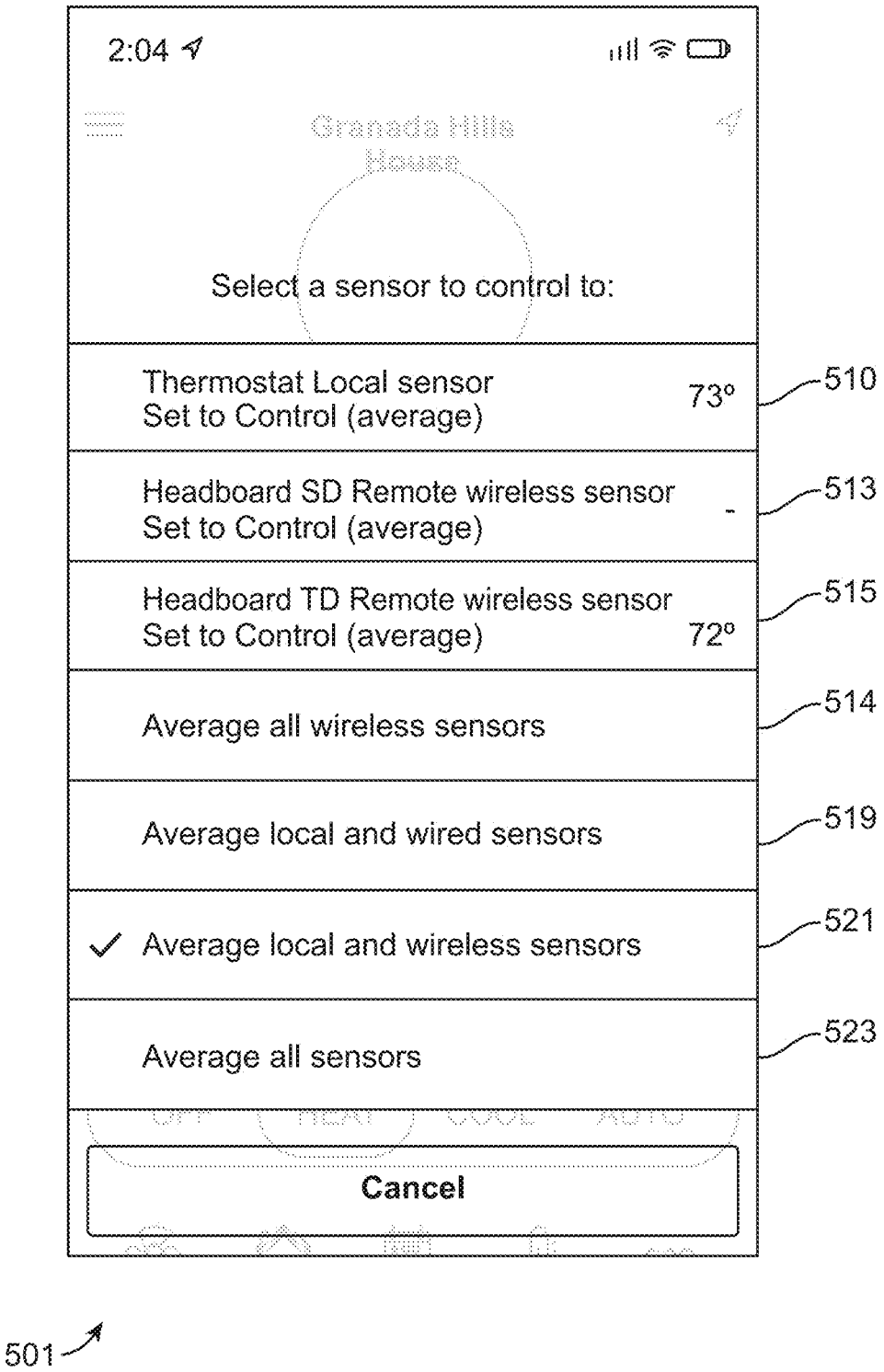
FIG. 11 is an exemplary screenshot of a display of a mobile device that appears after the end user selects "Control Source."

FIG. 11 is another exemplary screenshot 501 of a display of a mobile device 134 that appears after the end user 136 selects "Control Source" 426. The display may enable the user to select the temperature sensor in the thermostat 510, Headboard sensor 513, Headboard sensor 515, Average local and wired sensors 519, Average local and wireless sensors 521 (selected), and average all sensors 523.

In one or more embodiments, the user can easily select a specific temperature sensor. For example, as discussed above, in a home, the thermostat and its local/contained temperature sensor are located downstairs. At bedtime the occupant selects the upstairs temperature sensor for control on his way to bed upstairs. The HVAC system now uses the local upstairs remote sensor for control to make it comfortable for sleeping. Additionally, the control to sensor may also be chosen from more than one sensor when setting a time period schedule.

In an embodiment, the computing device 134 is further configured to communicate a schedule for selecting temperature sensors 120 and temperature setpoints to the computing cloud 132, the computing cloud 132 is further configured to communicate the schedule for selecting temperature sensors and temperature setpoints to the thermostat 122, and the thermostat 122 is further configured to control the HVAC system 123 by the based on the schedule for selecting temperature sensors and temperature setpoints.

Selection of the temperature sensors can be made with just 2 easy button presses. First, the user selects "Control Source" icon 426 at the bottom of the mobile app screen (See FIG. 9). Second, the user then selects the Upstairs remote wireless sensor. After selection the app reverts back to the home screen for that thermostat.

Figure 12:
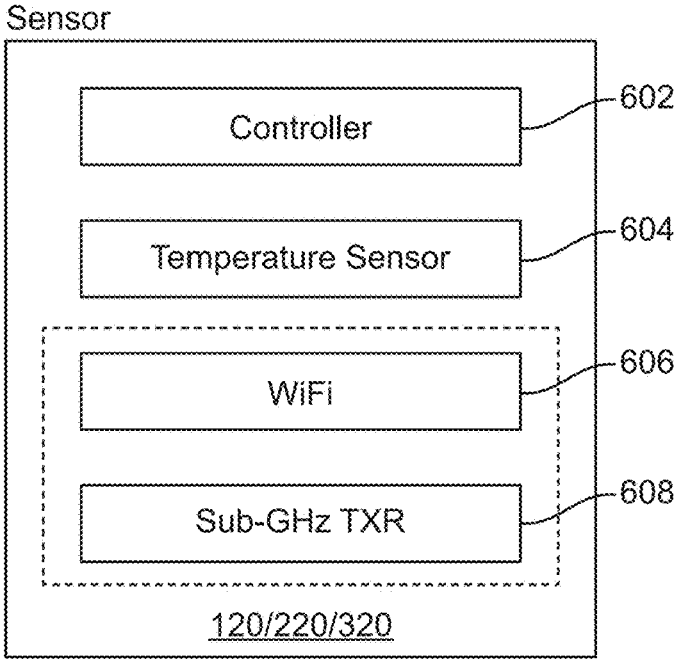
FIG. 12 is a schematic diagram of an exemplary sensor.

FIG. 12 is a schematic diagram of an exemplary sensor 120/220/320 which may comprise a controller 602, a temperature sensor 604, a Wi-Fi transceiver 606, and a sub-GHz transceiver 608. The dashed lines surrounding the Wi-Fi transceiver 606 and the Sub-GHz transceiver 608 indicate that each of these components may be optional in one or more embodiments. The Wi-Fi driver and transceiver 606 may communicate to the thermostat 122 via the access point 124. The sub-GHZ transceiver 608 may be employed to communicate directly with the thermostat 122.

Figure 13:
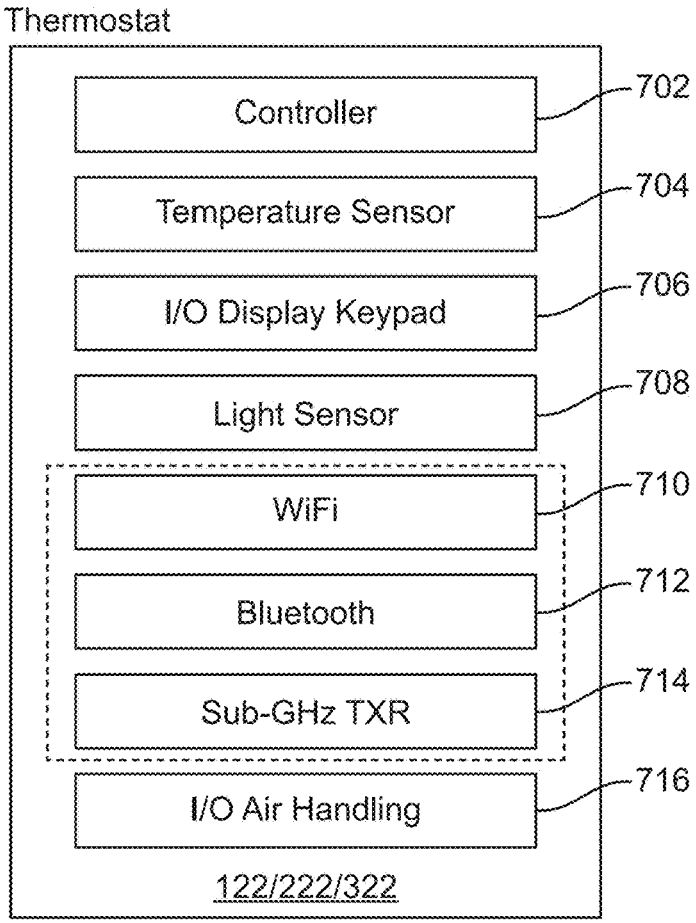
FIG. 13 is a schematic diagram of an exemplary thermostat.

FIG. 13 is a schematic diagram of an exemplary thermostat 122/222/322 which may comprise a controller 702, a temperature sensor 704, an I/O Display Keypad 706, a light sensor 708, a Wi-Fi transceiver 710, a Bluetooth transceiver 712, a sub-GHz transceiver 714, and I/O Air Handling circuitry 716. The dashed lines surrounding the Wi-Fi transceiver 710, the Bluetooth transceiver 712, and the Sub-GHz transceiver 714 indicate that each of these components may be optional in one or more embodiments. The Wi-Fi driver and transceiver 710 may communicate to the sensors 120 via the access point 124. The sub-GHZ transceiver 608 may be employed to communicate directly with the sensors 120.

An access point 124 is a networking hardware device that allows Wi-Fi devices to connect to a wired network such as an Ethernet or the Internet. In an embodiment, the Wi-Fi driver and transceiver 606, 710, working through an access point 124, enables the sensor 120 and the thermostat 122 to communicate to remote locations via the Internet.

Figure 14:
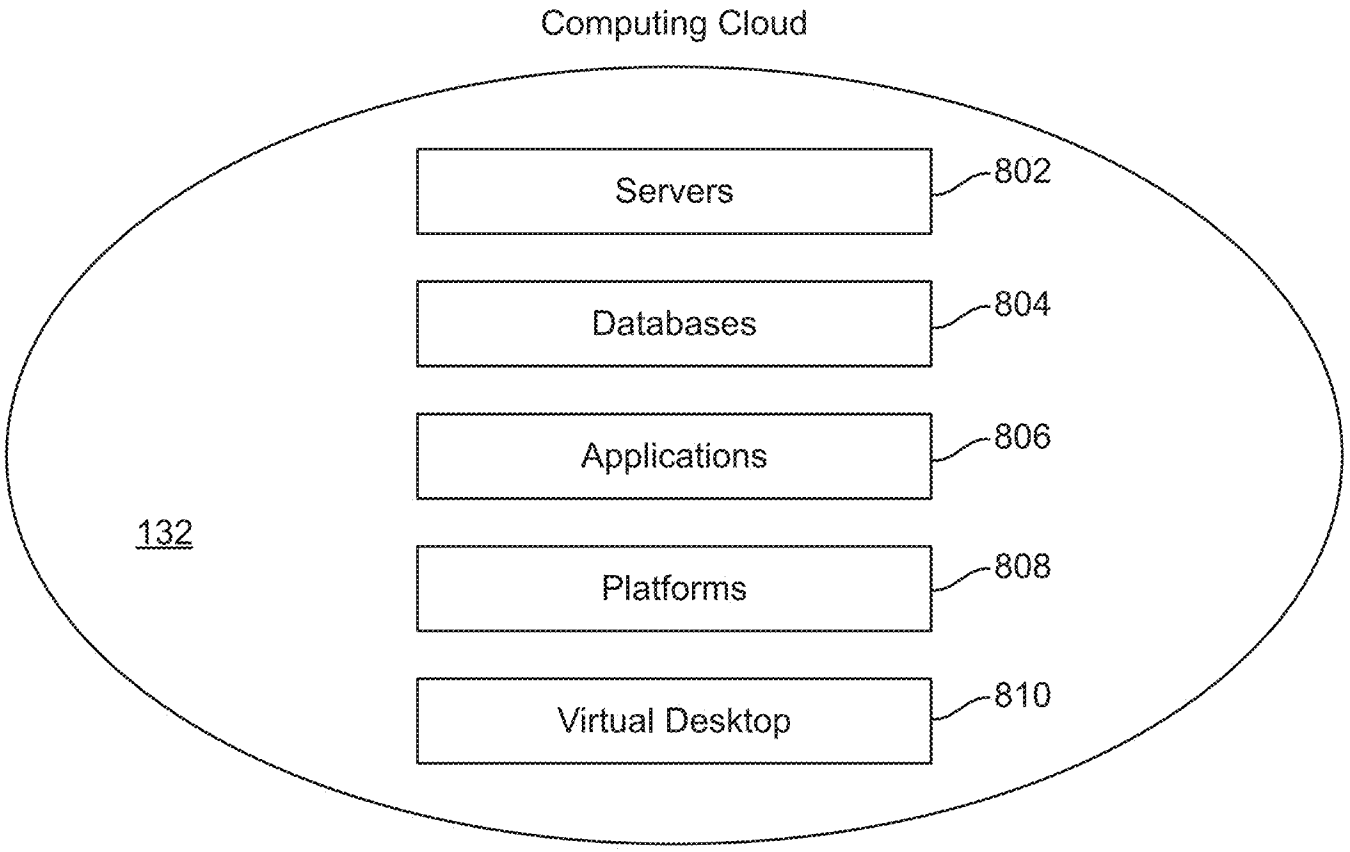
FIG. 14 is a schematic diagram of a computing cloud.

FIG. 14 is a schematic diagram of a computing cloud 132 which may comprise one or more servers 802, databases 804, applications 806, platforms 808, and virtual desktop 810 in one or more embodiments.

Although the invention has been discussed with reference to specific embodiments, it is apparent and should be understood that the concept can be otherwise embodied to achieve the advantages discussed. The preferred embodiments above have been described primarily as a method and system for remotely selecting a temperature sensor of an environment for a thermostat to monitor. In this regard, the foregoing description is presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

Unless specifically stated otherwise, it shall be understood that disclosure employing the terms "coupling," "receiving," "communicating," "computing," "determining," "calculating," and others refer to a data processing system or other electronic device manipulating or transforming data within the device memories or controllers into other data within the system memories or registers. When applicable, the ordering of the various steps described herein may be changed, combined into composite steps, or separated into sub-steps to provide the features described herein.

Computer programs such as a program, software, software application, code, or script may be written in any computer programming language including conventional technologies, object-oriented technologies, interpreted or compiled languages, and can be a module, component, or function. Computer programs may be executed in one or more processors or computer systems.

What is claimed is:

1. A system for controlling a local temperature of a zone within an environment, the system comprising:

one or more temperature sensors placed within an environment;

a thermostat controlling a Heating, Ventilation, and Air Conditioning ("HVAC") system, the thermostat paired with the one or more temperature sensors;

a computing device;

a computing cloud establishing a communication link with the thermostat, a communication link with the one or more temperature sensors, and a communication link with the computing device;

wherein:

the thermostat is configured to communicate a status of the thermostat to the computing cloud;

the one or more temperature sensors is configured to communicate a status of the one or more temperature sensors to the computing cloud;

the computing cloud is configured to transmit the status of the thermostat and one or more temperature sensors to the computing device;

the computing device is configured to communicate a selection of temperature sensors and temperature setpoints to the computing cloud, wherein the selection of temperature sensors is grouped based on whether the temperature sensors communicate via wireless or wired communication links, and whether the temperature sensors are placed within the thermostat or located remotely from the thermostat;

the computing cloud is configured to communicate the selection of temperature sensors and the temperature setpoints to the thermostat; and the thermostat is configured to control the HVAC system by the thermostat based on the selection of temperature sensors and the temperature setpoints.

2. The system for controlling the local temperature of the zone within the environment of claim 1, wherein the thermostat paired with the one or more temperature sensors comprises coupling the one or more temperature sensors to the thermostat via an access point.

3. The system for controlling the local temperature of the zone within the environment of claim 1, wherein the thermostat paired with the one or more temperature sensors comprises:

coupling the one or more temperature sensors to the computing cloud via an access point; and, coupling the computing cloud to the thermostat.

4. The system for controlling the local temperature of the zone within the environment of claim 1, wherein the thermostat paired with the one or more temperature sensors comprises coupling the one or more temperature sensors with a thermostat directly.

5. The system for controlling the local temperature of the zone within the environment of claim 1, the thermostat is configured to control the HVAC system by the thermostat based on the selection of temperature sensors and the temperature setpoints comprises:

receiving the current measured temperatures of the selected temperature sensors;

averaging the current measured temperatures to obtain an average measured temperature; and controlling the HVAC system based on the temperature setpoint and the average measured temperature.

6. The system for controlling the local temperature of the zone within the environment of claim 1, wherein the selection of temperature sensors is based on common characteristics of the selected temperature sensors.

7. The system for controlling the local temperature of the zone within the environment of claim 1, wherein:

the computing device is further configured to communicate a schedule for selecting temperature sensors and temperature setpoints to the computing cloud;

the computing cloud is further configured to communicate the schedule for selecting temperature sensors and temperature setpoints to the thermostat; and the thermostat is further configured to control the HVAC system by the based on the schedule for selecting temperature sensors and temperature setpoints.

8. The system for controlling the local temperature of the zone within the environment of claim 1, further comprising a software application executing on the computing device, wherein the computing device is further configured to display an indication status of the thermostat and sensors and receive commands from a user of the selection of temperature sensors and the temperature setpoints.

9. A method for controlling a local temperature of a zone within an environment in a system comprising a thermostat controlling a Heating, Ventilation, and Air Conditioning ("HVAC") system, one or more sensors placed within an environment, and a computing cloud, the method comprising:

pairing one or more temperature sensors with a thermostat;

establishing a communication link between the temperature sensors and a computing cloud, the sensors communicating a status of the sensors;

establishing a communication link between a thermostat and a computing cloud, the thermostat communicating a status of the thermostat;

transmitting the status of the thermostat and sensors from the computing cloud to a computing device;

communicating the selection of temperature sensors and a temperature setpoint from the computing device to the computing cloud;

communicating the selection of temperature sensors and the temperature setpoint from the computing cloud to the thermostat, wherein the selection of temperature sensors is grouped based on whether the temperature sensors communicate via wireless or wired communication links, and whether the temperature sensors are placed within the thermostat or located remotely from the thermostat; and controlling a HVAC system by the thermostat based on the selection of temperature sensors and the temperature setpoint.

10. The method for controlling the local temperature of the zone within the environment in the system comprising the thermostat controlling the HVAC system, the one or more sensors placed within the environment, and the computing cloud of claim 9, wherein the pairing the one or more temperature sensors with a thermostat comprises coupling the one or more temperature sensors to the thermostat via an access point.

11. The method for controlling the local temperature of the zone within the environment in the system comprising the thermostat controlling the HVAC system, the one or more sensors placed within the environment, and the computing cloud of claim 9, wherein the pairing the one or more temperature sensors with a thermostat comprises:

coupling the one or more temperature sensors to the computing cloud via an access point; and, coupling the computing cloud to the thermostat.

12. The method for controlling the local temperature of the zone within the environment in the system comprising the thermostat controlling the HVAC system, the one or more sensors placed within the environment, and the computing cloud of claim 9, wherein the pairing the one or more temperature sensors with a thermostat comprises coupling the one or more temperature sensors with a thermostat directly.

13. The method for controlling the local temperature of the zone within the environment in the system comprising the thermostat controlling a HVAC system, the one or more sensors placed within the environment, and the computing cloud of claim 9, wherein controlling a HVAC system by the thermostat based on the selection of temperature sensors and the temperature setpoint comprises:

receiving the current measured temperatures of the selected temperature sensors;

averaging the current measured temperatures to obtain an average measured temperature; and controlling the HVAC system based on the temperature setpoint and the average measured temperature.

14. The method for controlling the local temperature of the zone within the environment in the system comprising the thermostat controlling the HVAC system, the one or more sensors placed within the environment, and the computing cloud of claim 9, further comprising:

communicating a schedule for selecting temperature sensors and temperature setpoints from the computing device to the computing cloud;

communicating the schedule for selecting temperature sensors and temperature setpoints from the computing cloud to the thermostat; and controlling the HVAC system by the thermostat based on the schedule for selecting temperature sensors and temperature setpoints.

15. The method for controlling the local temperature of the zone within the environment in the system comprising the thermostat controlling the HVAC system, the one or more sensors placed within the environment, and the computing cloud of claim 9, further comprising:

executing a software application on the computing device;

displaying an indication status of the thermostat and sensors; and, receiving commands from a user of the selection of temperature sensors and the temperature setpoints.

16. A system for controlling a local temperature of a zone within an environment, the system comprising:

a thermostat controlling a Heating, Ventilation, and Air Conditioning ("HVAC") system, the thermostat paired with one or more temperature sensors;

a computing device:

a computing cloud establishing a communication link with the thermostat, a communication link with the one or more temperature sensors, and a communication link with the computing device;

wherein:

the thermostat is configured to communicate a status of the thermostat to the computing cloud;

the one or more temperature sensors is configured to communicate a status of the one or more temperature sensors to the computing cloud;

the computing cloud is configured to transmit the status of the thermostat and sensors to a computing device;

the computing device is configured to communicate a selection of temperature sensors and temperature setpoints to the computing cloud, wherein the selection of temperature sensors is grouped based on whether the temperature sensors communicate via wireless or wired communication links, and whether the temperature sensors are placed within the thermostat or located remotely from the thermostat;

the computing cloud is configured to communicate the selection of temperature sensors and the temperature setpoints to the thermostat; and the thermostat is configured to control the HVAC system by the thermostat based on the selection of temperature sensors and the temperature setpoints.

17. The system for controlling the local temperature of the zone within the environment of claim 16, wherein the thermostat paired with the one or more temperature sensors comprises coupling the one or more temperature sensors to the thermostat via an access point.

18. The system for controlling the local temperature of the zone within the environment of claim 16, wherein the thermostat paired with the one or more temperature sensors comprises:

coupling the one or more temperature sensors to the computing cloud via an access point; and, coupling the computing cloud to the thermostat.

19. The system for controlling the local temperature of the zone within the environment of claim 16, wherein the thermostat paired with the one or more temperature sensors comprises coupling the one or more temperature sensors with a thermostat directly.

* * * * *